US011805864B1

(12) United States Patent
Chung

(10) Patent No.: US 11,805,864 B1
(45) Date of Patent: Nov. 7, 2023

(54) LOWER STOP DEVICE OF AN ANTI-PINCH ZIPPER AND ITS ASSEMBLY STRUCTURE

(71) Applicant: KCC ZIPPER CO., LTD., Tong Xiang (CN)

(72) Inventor: Chun-Yen Chung, New Taipei (TW)

(73) Assignee: KCC ZIPPER CO., LTD., Zhejiang (CN)

( * ) Notice: Subject to any disclaimer, the term of this patent is extended or adjusted under 35 U.S.C. 154(b) by 0 days.

(21) Appl. No.: 17/840,331

(22) Filed: Jun. 14, 2022

(30) Foreign Application Priority Data

May 9, 2022 (TW) ..... 111117352
May 9, 2022 (TW) ..... 111204755

(51) Int. Cl.
*A44B 19/38* (2006.01)

(52) U.S. Cl.
CPC ..... *A44B 19/388* (2013.01)

(58) Field of Classification Search
CPC ..... A44B 19/388
See application file for complete search history.

(56) References Cited

U.S. PATENT DOCUMENTS 2,358,179 A * 9/1944 Marinsky ..... A44B 19/388 24/433
2,625,726 A * 1/1953 Austin ..... A44B 19/388 24/433
2,974,382 A * 3/1961 Carlile ..... A44B 19/388 24/433
3,752,718 A * 8/1973 Potin ..... B29C 66/21 24/434
5,272,793 A * 12/1993 Wilk ..... A44B 19/388 24/433
6,112,376 A * 9/2000 Akashi ..... A44B 19/388 24/433
9,565,905 B2 * 2/2017 Huang ..... A44B 19/36
2003/0213106 A1 * 11/2003 Ichikawa ..... A44B 19/388 24/433
2004/0205942 A1 * 10/2004 Tsaur ..... A44B 19/388 24/433
2005/0050699 A1 * 3/2005 Yoneoka ..... A44B 19/388 24/433
2006/0075612 A1 * 4/2006 Wu ..... A44B 19/388 24/433

(Continued)

FOREIGN PATENT DOCUMENTS

EP 1321062 A2 * 6/2003 ..... A44B 19/388
EP 1525816 A1 * 4/2005 ..... A44B 19/388

*Primary Examiner* — Jason W San
(74) *Attorney, Agent, or Firm* — Che-Yang Chen; Law Office of Michael Chen

(57) ABSTRACT

The present invention proposes a lower stop device of an anti-pinch zipper and an assembly structure thereof, which includes a lower stop block and a movable pin for combining two chain fabrics of the anti-pinch zipper. The lower stop block and the movable pin are respectively formed at the lower ends of the two chain fabrics by injection molding. The lower stop block and the movable insert respectively have a groove structure for stabilizing the folded chain tooth belt of the chain fabric, and a support structure for sandwiching the front and back sides of the chain fabric. In this way, the purpose of stabilizing the anti-pinch zipper chain fabric structure and resisting lateral tension can be achieved.

7 Claims, 8 Drawing Sheets

(56) References Cited

U.S. PATENT DOCUMENTS

| | | | | |
|---|---|---|---|---|
| 2008/0222855 | A1* | 9/2008 | Takani | A44B 19/388<br>24/433 |
| 2013/0061436 | A1* | 3/2013 | Peters | A44B 99/00<br>24/430 |
| 2014/0201958 | A1* | 7/2014 | Huang | A44B 19/36<br>24/435 |
| 2016/0157567 | A1* | 6/2016 | Peng | A44B 19/36<br>24/388 |
| 2017/0127771 | A1* | 5/2017 | Sato | A44B 19/38 |
| 2020/0275745 | A1* | 9/2020 | Tung | A44B 19/38 |
| 2021/0289893 | A1* | 9/2021 | Owings | A44B 19/38 |

* cited by examiner

LOWER STOP DEVICE OF AN ANTI-PINCH ZIPPER AND ITS ASSEMBLY STRUCTURE

BACKGROUND OF THE INVENTION

(a) Field of the Invention

The present invention relates to anti-pinch zipper technology and more particularly, to a lower stop device of an anti-pinch zipper and its assembly structure, so that the anti-pinch zipper can be applied as an open-tail anti-pinch zipper.

(b) Description of the Prior Art

The zippers commonly used on clothing today, whether they are used in the pockets of clothing, the opening of the trousers/skirts, or the two plackets of the jacket, as long as the clothing has an inner lining, when the zipper slider moves, it may clamp the fabric inside, causing the zipper slider to move unevenly. If it is seriously involved in the inner fabric, it will cause the entire zipper slider to be stuck and completely unable to advance or retreat. It often requires destructive repairs to restore the original functions of the clothing and the zipper. To this end, the prior art has proposed a variety of anti-pinch zipper design solutions, such as those shown in WO2014033926A1, U.S. Pat. No. 6,701,584B2, EP3289908A1, CN107567291A, CN106333432A, CN104106888A, CN211298642U and other patent cases, but the above technologies are not ideal. The applicant in this case has proposed an anti-pinch zipper (U.S. patent application Ser. No. 17/552,671).

The anti-pinch zipper shown in the above U.S. patent application Ser. No. 17/552,671 is mainly characterized in that the inner side of the chain cloth is folded into a chain tooth belt, and then the chain teeth are combined in front of the chain tooth belt, and then a zipper slider with a special structure is used to drive the chain teeth so that the chain tooth belts are linked or separated. When the zipper slider slides, the two wings on its back move in the sliding space under the chain tooth belts. The use of chain cloth barrier function, so the two wings will not touch the inner lining of the clothing, which can achieve the function of anti-pinch. However, when the above-mentioned anti-pinch zipper structure is to be further applied as an open-end anti-pinch zipper, the lower end of the anti-pinch zipper still lacks the ability to stabilize the reflex structure, so as to have a better technical solution for the lower stop device with better resistance to lateral tension and easier insertion of the lower end of the zipper. To this end, the applicant of the present case further proposes a lower stop device for an anti-pinch zipper and its assembly structure to overcome the above-mentioned problems.

SUMMARY OF THE INVENTION

The present invention has been accomplished under the circumstances in view. It is the main object of the present invention to provide a lower stop device of an anti-pinch zipper and its assembly structure, which stabilizes the shape of the folded chain tooth belt of the anti-pinch zipper chain fabric, has better resistance to lateral tension and easier insertion and use.

In order to achieve the above-mentioned object, the lower stop device of the anti-pinch zipper of the present invention and its assembly structure, its preferred technical scheme comprises: a lower stop block and a movable pin respectively combined with the lower ends of the two chain straps of an anti-pinch zipper. The lower stop block is a component that provides movable pin insertion and extraction, and is formed at the lower end of the chain fabric by direct injection. The lower stop block has a groove structure for stabilizing the chain fabric folded chain tooth belt, and a support structure for sandwiching the front and back sides of the chain fabric. The movable pin is also formed at the lower end of the other chain fabric by direct injection, which is used to guide the other chain fabric to pass through the zipper slider, and then insert the movable pin into the lower stop block, so that when the zipper slider moves, it can drive the two chain straps meshing. The movable pin also has a groove structure that stabilizes the folded chain tooth belt of the other chain fabric, and a support structure that clamps the front and back sides of the other chain fabric.

The lower stop device of the anti-pinch zipper of the present invention and its assembly structure can achieve the following effects:

1. It stabilizes the folded chain tooth belt of the anti-pinch zipper chain fabric in shape. The present invention is to enable the chain tooth belt of the anti-pinch zipper shown in the U.S. patent application Ser. No. 17/552,671 to maintain a folded structure, so that the anti-pinch zipper can be further applied as an open-tail type anti-pinch zipper.

2. It has better resistance to lateral tension. Because the open-end anti-pinch zipper is usually used on the two plackets of the jacket, it is often pulled apart or plugged together by the user. The present invention enables the lower stop device of the anti-pinch zipper to have a better anti-transverse tensile force effect through the structure that can be clamped and shaped on the front and back sides of the chain fabric by injection molding. It can more effectively maintain the anti-pinch structure of the chain fabric's folded shape, and make it easier to insert the zipper when opening and closing.

DETAILED DESCRIPTION OF THE PREFERRED EMBODIMENTS

Figure 1:
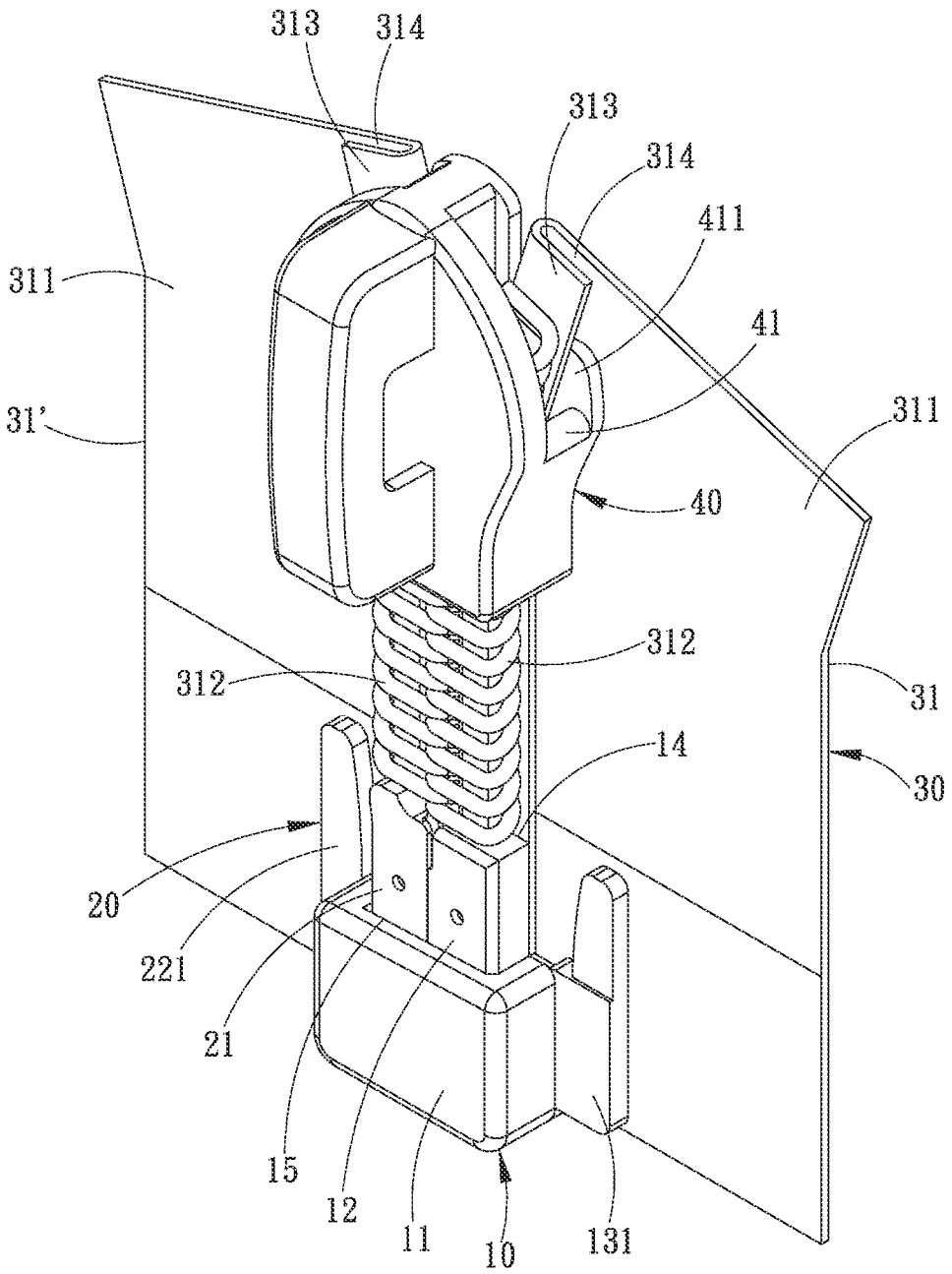
FIG. 1 is a three-dimensional schematic diagram of the application of the present invention to become an open-tail anti-pinch zipper.
Figure 2:
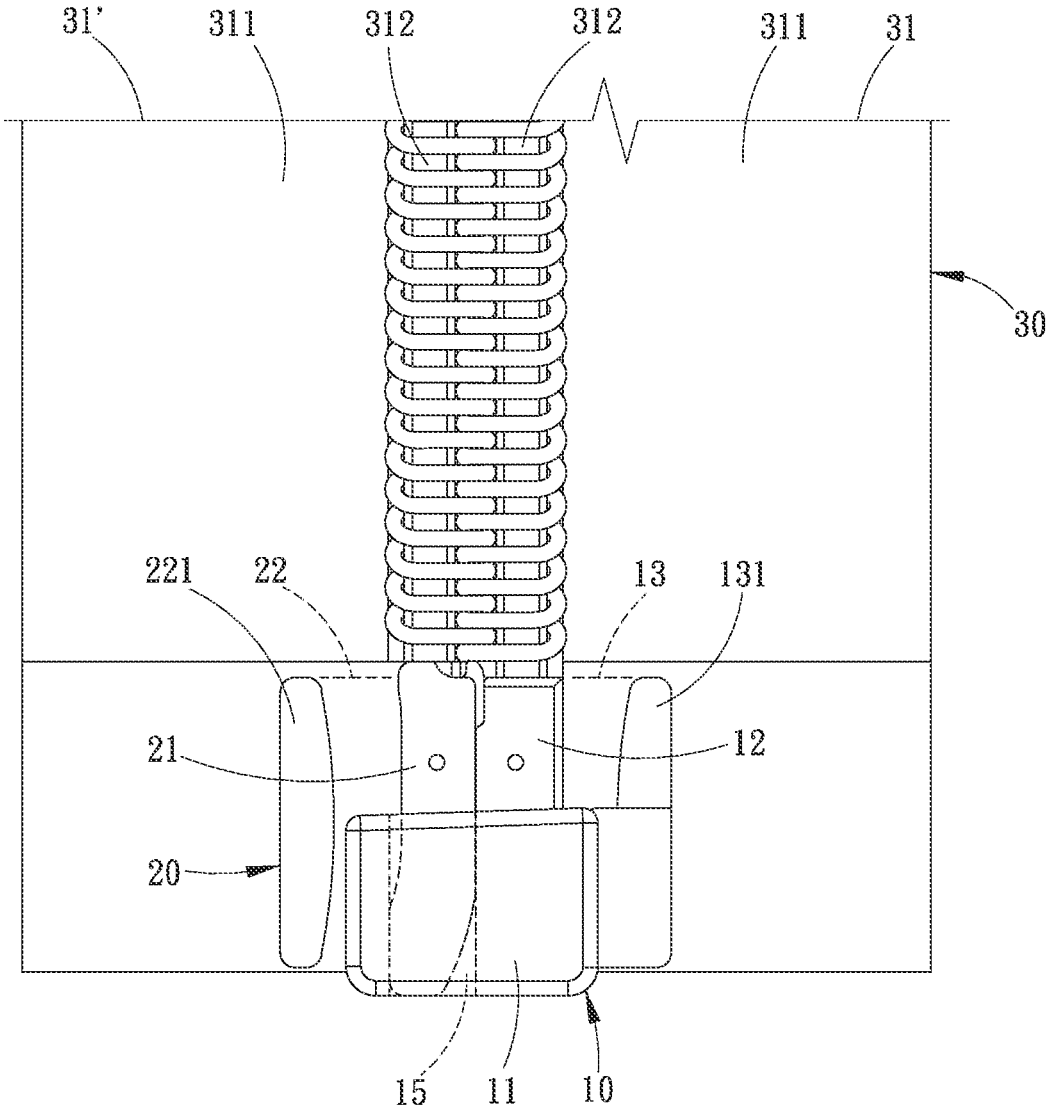
FIG. 2 is a schematic diagram of the front view of the assembly structure of the anti-pinch zipper lower stop device of the present invention.
Figure 3:
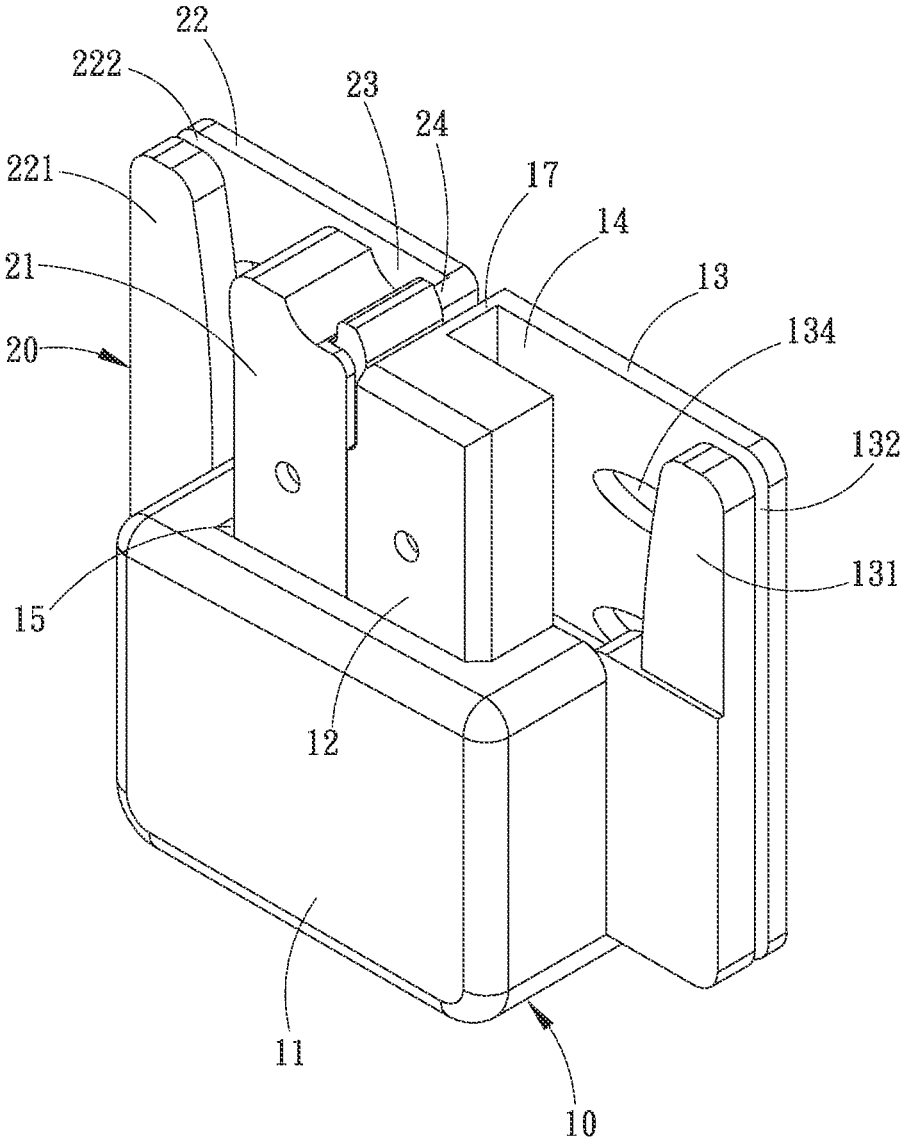
FIG. 3 is the combined perspective view of the lower stop device of the anti-pinch zipper of the present invention.
Figure 4:
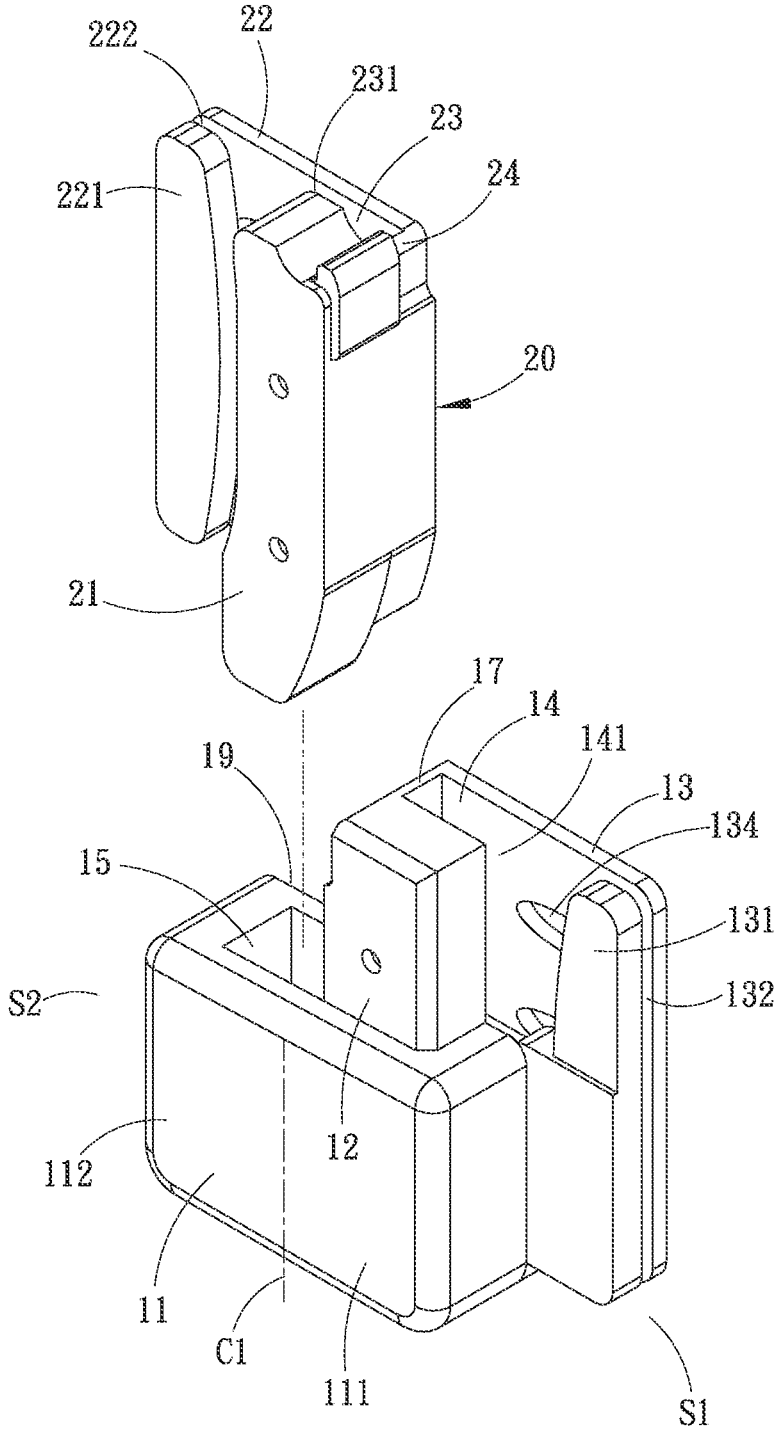
FIG. 4 is a schematic exploded view of the lower stop device of the anti-pinch zipper of the present invention.
Figure 5:
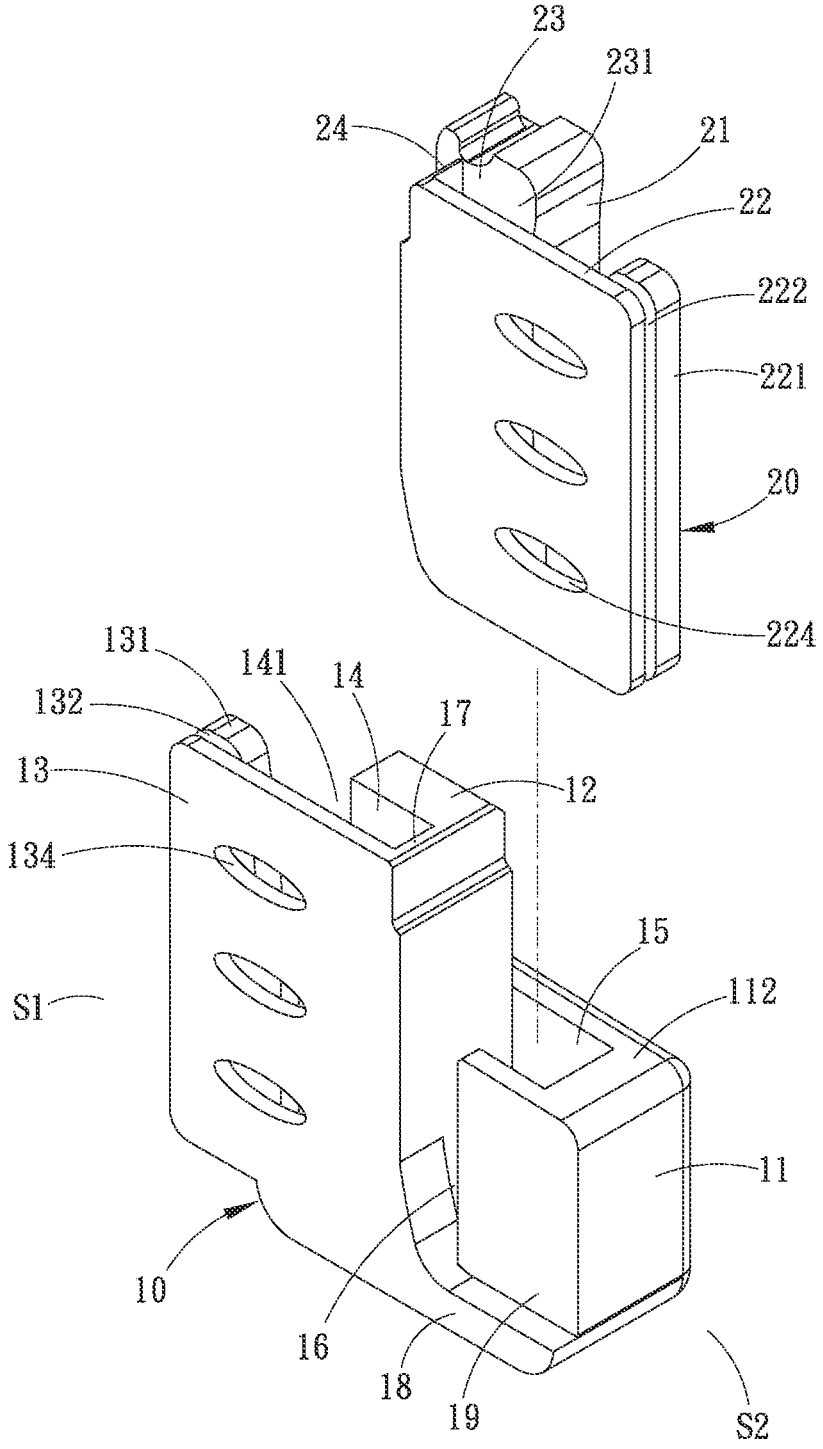
FIG. 5 is a rear exploded view of the lower stop device of the anti-pinch zipper of the present invention.

Referring to FIG. 1 and FIG. 2, the lower stop device of the anti-pinch zipper of the present invention is used to combine the lower ends of the two chain straps 31, 31' of an anti-pinch zipper 30. When the two chain straps 31, 31' are completely pulled apart by a zipper slider 40, the lower ends of the two chain straps 31, 31' can be disassembled and separated; and when the two chain straps 31, 31' are driven and linked by the zipper slider 40, the lower ends of the two chain straps 31, 31' are joined together. Therefore, it is suitable to be used as an open-ended anti-pinch zipper, which is further installed on the front of the jacket, etc. Referring to FIG. 3, FIG. 4 and FIG. 5 again, its preferred embodiment includes a lower stop block 10 and a movable pin 20.

The lower stop block 10 is used to be combined at the lower end of the chain fabric 311 of one of the two chain straps 31, 31'.

Figure 6:
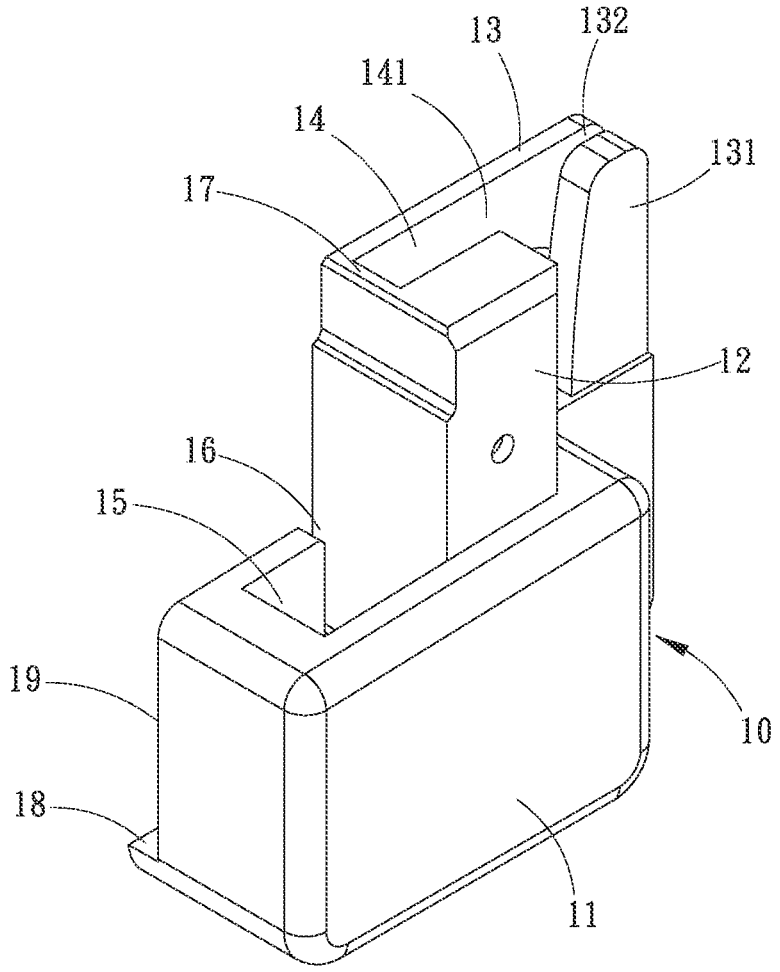
FIG. 6 is a perspective schematic diagram of the preferred embodiment of the lower stop block of the present invention.
Figure 7:
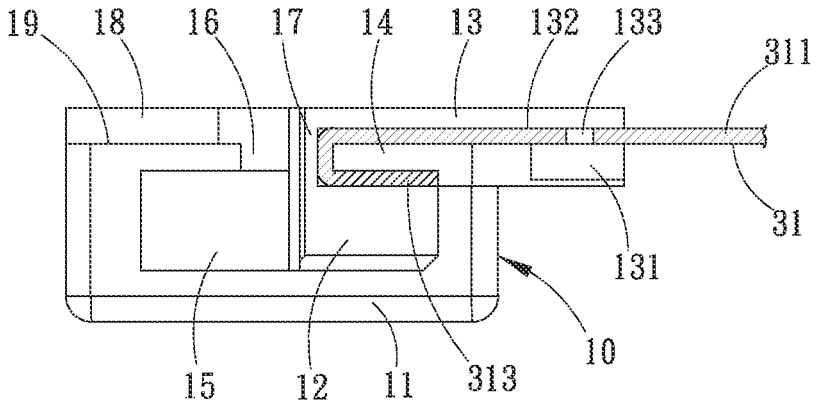
FIG. 7 is a schematic top view of a preferred embodiment of the lower stop block of the present invention.
Figure 8:
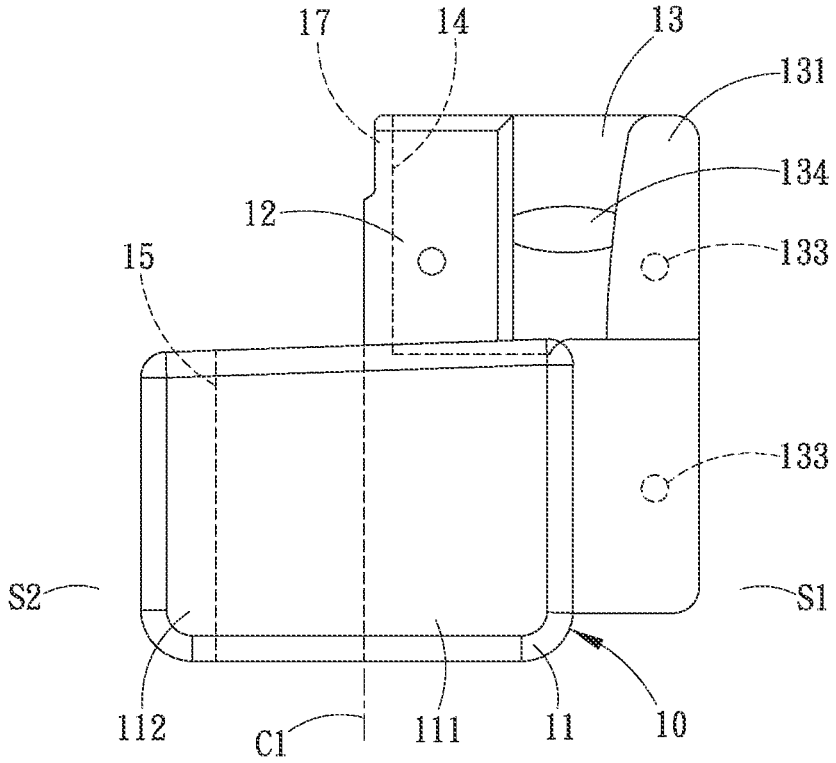
FIG. 8 is a schematic diagram of the front view of the preferred embodiment of the lower stop block of the present invention.

As shown in FIG. 6 to FIG. 8, the lower stop block 10 is integrally formed with a block 11, a fixed pin 12, a first support piece 13, a first chain fabric groove 14, an insertion slot 15 and a communication slot 16. As shown in FIG. 4 and FIG. 8, the two sides of the center line Cl of the block are respectively defined as a first half 111 and a first side S1, and a second half 112 and a second side S2. The fixed pin 12 protrudes upward from the upper end of the first half 111. The first support piece 13 is connected behind the block 11 and the fixed pin 12, and protrudes laterally from the outer edge of the block 11 and the fixed pin 12 to the first side S1. A first clamping block 131 is formed in front of the outer side of the first support piece 13. The first chain fabric groove 14 is located between the fixed pin 12 and the first support piece 13, it extends downward from the upper end of the fixed pin 12 to the upper end of the block 11, and has a first opening 141 facing the upper end of the fixed pin 12 and the first side S1. The insertion slot 15 extends downward from the upper end of the second half 112 of the block 11, and provides that the movable pin 20 is inserted into the insertion slot 15 downward from the upper end of the block 11, so that the lower ends of the two chain straps 31, 31' can be joined together. The communication slot 16 is located in the second half 112 and extends downward at the position adjacent to the center line Cl, and communicates the insertion slot 15 with the back of the block 11. Furthermore, the front of the inner side of the first support piece 13 has a first connecting portion 17 connected behind the fixed pin 12, and the first connecting portion 17 is adjacent to the first chain fabric groove 14.

The movable pin 20 is used to combine at the lower end of the other chain strap 31' of the two chain straps 31, 31'. Referring to FIG. 4, FIG. 5, FIG. 9 and FIG. 10 together, the movable pin 20 is integrally formed with a pin body 21, a second support piece 22 and a second chain fabric groove 23. The pin body 21 is a strip body corresponding to the cross-sectional shape of the above-mentioned insertion slot 15, such as a rectangular strip-shaped body, for inserting the above-mentioned insertion slot 15 of the lower stop block 10 after passing through the zipper slider 40. The second support piece 22 is connected behind the pin body 21 and protrudes laterally on the outer side of the pin body 21. When the pin body 21 is inserted into the above-mentioned insertion slot 15, the second support piece 22 is positioned at the second side S2 of the block 11, and a second clamping block 221 is formed in front of the outer edge of the second support piece 22. The second chain fabric groove 23 is formed between the pin body 21 and the second support piece 22. The second chain fabric groove 23 has a second opening 231 facing the upper end of the pin body 21 and its outer side. The front of the inner side of the second support piece 22 has a second connecting portion 24 connected behind the pin body 21. The second connecting portion 24 is adjacent to the second chain fabric groove 23.

Referring to FIG. 5 again, the preferred embodiment of the above-mentioned lower stop block 10 can be integrally formed with a lower edge 18 and an accommodating recess 19. The lower edge 18 is located at the rear lower edge of the second half 112 of the block 11, and is laterally connected to the inner side of the first support piece 13. The accommodating recess 19 is formed above the lower edge 18 and at the back of the second half 112 of the block 11, for when the pin body 21 of the above-mentioned movable pin 20 is inserted into the insertion slot 15, the second support piece 22 is just matched on the accommodating recess 19, and the lower edge 18 can also resist the lower edge of the second support piece 22. The communication slot 16 of the lower stop block 10 can be used to accommodate the second connecting portion 24 of the inner side of the second support piece 22 when the pin body 21 is inserted into the insertion slot 15, so that the lower stop block 10 and the back of the movable pin 20 are kept flat, and the stability of the combination of the movable pin 20 and the lower stop block 10 can be improved.

Figure 9:
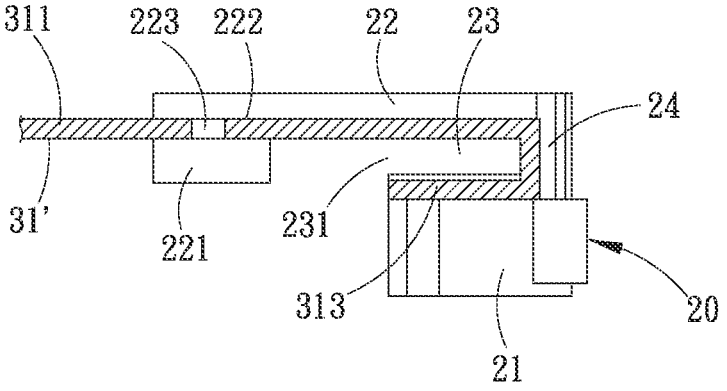
FIG. 9 is a schematic top view of a preferred embodiment of the movable pin of the present invention.
Figure 10:
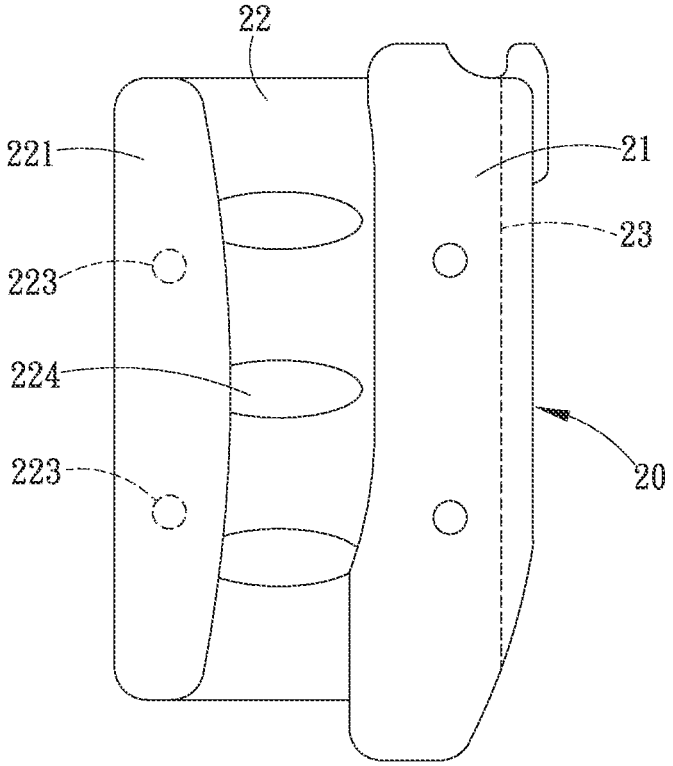
FIG. 10 is a schematic diagram of the front view of the preferred embodiment of the movable pin of the present invention.

Referring to FIG. 6 and FIG. 7 again, there is a first cloth seam 132 between the first support piece 13 of the above-mentioned lower stop block 10 and the first clamping block 131. The first support piece 13 and the first clamping block 131 are connected together by at least one first connecting pin 133, two first connecting pins 133 are shown in the figure. Referring to FIG. 9 and FIG. 10, there is a second cloth seam 222 between the second support piece 22 of the movable pin 20 and the second clamping block 221. The second support piece 22 and the second clamping block 221 are connected together by at least one second connecting pin 223, two second connecting pins 223 are shown in the figure. Furthermore, the first support piece 13 and the second support piece 22 are respectively provided with at least one through hole 134, 224 connecting the front and rear thereof, and three through holes 134, 224 are shown in the figure respectively.

Referring to FIG. 1 and FIG. 2 again, the present invention further proposes its assembly structure based on the lower stop device of the anti-pinch zipper, which includes an anti-pinch zipper 30. The anti-pinch zipper 30 is like the U.S. patent application Ser. No. 17/552,671 previously filed by the present invention, which comprises two chain straps 31, 31' and a zipper slider 40 that drives the two chain straps 31, 31' to be linked or separated from each other. The two chain straps 31, 31' respectively comprise a chain fabric 311 and a series of teeth 312. The inner side of each chain fabric 311 is folded to the outer side toward the front side of the chain fabric 311 to form a chain tooth belt 313. A sliding space 314 is formed between the chain tooth belt 313 and the chain fabric 311, and the opening side of the sliding space 314 faces the outer edge of the chain fabric 311. The series of teeth 312 is nylon series of teeth or plastic series of teeth, which is combined in front of the chain tooth belt 313 on the front side of the chain fabric 311, so that the series of teeth 312 is located on the front side of the chain fabric 311. The reverse side of the chain fabric 311 can just cover the series of teeth 312. The zipper slider 40 is the zipper slider of the anti-pinch zipper of the U.S. patent application Ser. No. 17/552,671 previously filed by the present case. When it slides, the convex plate 411 of the second guide plate 41 on both sides of the zipper slider 40 can slide in the sliding space 314 under the chain tooth belt 313, preventing contact with the inner lining of the clothes, so as to achieve the anti-pinch function.

Based on the above-mentioned structure of the anti-pinch zipper 30, the lower stop block 10 of the present invention adopts plastic injection molding at the lower end of the chain fabric 311 of one of the two chain straps 31, 31', so that the inner side of the chain fabric 311 and its chain tooth belt 313 are fixed in the first chain fabric groove 14 (as shown in FIG. 7). When the lower stop block 10 is injection molded (in-mold injection molding), not only the first chain fabric groove 14 is made to fix the inner side of the chain fabric 311 and its chain tooth belt 313, but also the block 11 of the lower stop block 10 and the fixed pin 12 are also engaged in front of the chain tooth belt 313 of the chain fabric 311, the first clamping block 131 is also closely connected to the front of the chain fabric 311, and the first support piece 13 is located behind the chain fabric 311, so that the front of the first support piece 13 is closely connected to the back of the chain fabric 311. Thereby, the structure in which the lower stop block 10 is firmly combined with the front and back of the chain fabric 311 is formed. The shape of the folded chain tooth belt 313 is maintained by the first chain fabric groove 14, and the chain fabric 311 is clamped by the first support piece 13 and the first clamping block 131, which has a better effect of resisting lateral tension.

Based on the above-mentioned structure of the anti-pinch zipper 30, the movable pin 20 of the present invention adopts plastic injection molding at the lower end of the chain fabric 311 of the other chain strap 31' of the two chain straps 31, 31', so that the inner side of the other chain fabric 311 and its chain tooth belt 313 are fixed in the second chain fabric groove 23 (as shown in FIG. 9). The pin body 21 is joined in front of the chain tooth belt 313 of the other chain fabric 311, and the second support piece 22 is located behind the other chain fabric 311, so that the front of the second support piece 22 is closely connected to the back of the other chain fabric 311. Thereby, a structure in which the movable pin 20 is firmly combined with the front and back sides of the other chain fabric 311 is formed. The second chain fabric groove 23 maintains the shape of the folded chain tooth belt 313 of the other chain fabric 311, and uses the second support piece 22 and its second clamping block 221 to clamp the front and back surfaces of the other chain fabric 311, so that it has a better effect of resisting lateral tension.

As described above, there is a first cloth seam 132 structure between the first support piece 13 and the first clamping block 131 of the present invention. Therefore, when the lower stop block 10 is injection-molded, the chain fabric 311 of one of the two chain straps is accommodated in the first cloth seam 132, and through the first connecting pin 133 passing through the chain fabric 311, the first support piece 13 and the first clamping block 131 are connected together again, which can produce the effect of resisting lateral force. In addition, there is a second cloth seam 222 between the second support piece 22 and its second clamping block 221. Therefore, when the lower end of the chain fabric 311 of the other chain strap 31' of the two chain straps 31, 31' is injection-molded to form the movable pin 20, the other chain fabric 311 is accommodated in the second cloth seam 222, and through the second connecting pin 223 passing through the other chain fabric 331, the second support piece 22 and its second clamping block 221 are connected together again, the effect of resisting lateral force can be generated.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lower stop device for anti-pinch zipper, comprising a lower stop block and a movable pin for combining with the lower ends of the two chain straps of an anti-pinch zipper respectively, wherein said lower stop block is used to be combined at a lower end of one chain fabric of the two chain straps of said anti-pinch zipper, said lower stop block comprising integrally a block, a fixed pin, a first support piece, a first chain fabric groove, an insertion slot and a communication slot, two sides of the center line of said block being respectively defined as a first half and a first side, and a second half and a second side, said fixed pin protruding upward from an upper end of said first half, said first support piece being connected at a back side of said block and said fixed pin and protruding laterally from an outer edge of said block and said fixed pin to said first side, a first clamping block being formed on an outer side of said first support piece, said first chain fabric groove being located between said fixed pin and said first support piece and extending downward from an upper end of said fixed pin to an upper end of said block and having a first opening facing the upper end of said fixed pin and said first side, said insertion slot extending downward from an upper end of said second half of said block and providing that said movable pin is inserted into said insertion slot downward from the upper end of said block, said communication slot being located in the second half and extends downward at the position adjacent to said center line and communicating said insertion slot with a back of said block; said movable pin is used to combine at the lower end of the other said chain strap, said movable pin comprising integrally formed with a pin body, a second support piece and a second chain fabric groove, said pin body being a strip body corresponding to the cross-sectional shape of said insertion slot, said second support piece being connected at a back side of said pin body and protruding laterally on an outer side of said pin body, said pin body being inserted into said insertion slot so that said second support piece is positioned at said second side of said block, a second clamping block being formed on an outer edge of said second support piece, said second chain fabric groove being formed between said pin body and said second support piece, said second chain fabric groove having a second opening facing an upper end and an outer side of said pin body, wherein a first cloth seam is provided between said first support piece and said first clamping block, the chain fabric of one of said two chain straps is accommodated in said first cloth seam, and said first support piece and said first clamping block are connected together by a first connecting pin through the chain fabric; a second cloth seam is provided between said second support piece and said second clamping block, the chain fabric of the other of said two chain straps is accommodated in said second cloth seam, and said second support piece and said second clamping block are connected together by a second connecting pin through the other said chain fabric.

2. The lower stop device for anti-pinch zipper as claimed in claim 1, wherein said first support piece comprises a first connecting portion located on a front inner side thereof and connected at a back side of said fixed pin adjacent to said first chain fabric groove.

3. The lower stop device for anti-pinch zipper as claimed in claim 2, wherein said second support piece comprises a second connecting portion located on a front inner side thereof and connected at a back side of said pin body adjacent to said second chain fabric groove.

4. The lower stop device for anti-pinch zipper as claimed in claim 3, wherein said lower stop block comprises integrally a lower edge and an accommodating recess, said lower edge being located at a rear lower edge of said second half of said block and is laterally connected to an inner side of said first support piece, said accommodating recess being formed above said lower edge and at a back of said second half of said block, for when said pin body of said movable pin is inserted into said insertion slot, said second support piece is just matched on said accommodating recess, and the lower edge resists a lower edge of said second support piece, and said communication slot of said lower stop block accommodates said second connecting portion of said second support piece.

5. The lower stop device for anti-pinch zipper as claimed in claim 1, wherein a first cloth seam is provided between said first support piece and said first clamping block, and said first support piece and said first clamping block are connected together by at least one first connecting pin; a second cloth seam is provided between said second support piece and said second clamping block, and said second support piece and said second clamping block are connected together by at least one second connecting pin.

6. The lower stop device for anti-pinch zipper as claimed in claim 5, wherein said first support piece and said second support piece are provided with a through hole connecting the front and back thereof.

7. An assembly structure of a lower stop device of an anti-pinch zipper comprises an anti-pinch zipper, said anti-pinch zipper comprising two chain straps and a zipper slider that drives said two chain straps to be linked or separated from each other, said two chain straps respectively comprising a chain fabric and a series of teeth, an inner side of each said chain fabric being folded to an outer side toward a front side of said chain fabric to form a chain tooth belt, a sliding space being formed between said chain tooth belt and said chain fabric, the opening side of said sliding space facing an outer edge of said chain fabric, said series of teeth being combined on said chain tooth belt on the front side of said chain fabric, so that said series of teeth is located on the front side of said chain fabric, and the back side of said chain fabric covers said series of teeth;

wherein said lower stop block is plastic injection molded at the lower end of one of said two chain straps, so that the inner side of said chain fabric and the chain tooth belt thereof are fixed in said first chain fabric groove, said block and said fixed pin are joined in front of said chain tooth belt of said chain fabric, said first clamping block is in close contact with the front of said chain fabric, and the front of said first support piece is in close contact with the back of said chain fabric; and said movable pin is plastic injection molded at the lower end of the other said chain fabric, so that the inner side of the other said chain fabric and the chain tooth belt thereof are fixed in said second chain fabric groove, said pin body is joined in front of the chain tooth belt of the other said chain fabric, and the front of said second support piece is closely connected to the back of the other said chain fabric, wherein a first cloth seam is provided between said first support piece and said first clamping block, the chain fabric of one of said two chain straps is accommodated in said first cloth seam, and said first support piece and said first clamping block are connected together by a first connecting pin through the chain fabric; a second cloth seam is provided between said second support piece and said second clamping block, the chain fabric of the other of said two chain straps is accommodated in said second cloth seam, and said second support piece and said second clamping block are connected together by a second connecting pin through the other said chain fabric.

* * * * *